US009219350B1

(12) United States Patent
Shibata

(10) Patent No.: US 9,219,350 B1
(45) Date of Patent: Dec. 22, 2015

(54) SPARK PLUG FOR INTERNAL COMBUSTION ENGINE

(71) Applicant: DENSO CORPORATION, Kariya, Aichi-pref. (JP)

(72) Inventor: Masamichi Shibata, Toyota (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/790,013

(22) Filed: Jul. 2, 2015

(30) Foreign Application Priority Data

Jul. 2, 2014 (JP) ..... 2014-136946
Jul. 2, 2014 (JP) ..... 2014-136947

(51) Int. Cl.
*H01T 13/20* (2006.01)

(52) U.S. Cl.
CPC ..... *H01T 13/20* (2013.01)

(58) Field of Classification Search
CPC ..... H01T 13/20
USPC ..... 313/141, 118, 132
See application file for complete search history.

(56) References Cited

U.S. PATENT DOCUMENTS 8,188,642 B2 * 5/2012 Ishida ..... H01T 13/39 313/118
8,242,673 B2 * 8/2012 Nunome ..... H01T 13/20 313/118

FOREIGN PATENT DOCUMENTS

JP 2009-176525 8/2009

* cited by examiner

*Primary Examiner* — Vip Patel
(74) *Attorney, Agent, or Firm* — Nixon & Vanderhye PC

(57) ABSTRACT

A spark plug includes a tubular housing, a tubular insulator retained in the housing, a center electrode secured in the insulator, and a ground electrode provided at a distal end of the housing. The housing has a seat portion formed on its inner periphery. The insulator has a distal portion, a proximal portion, and a shoulder formed on an outer periphery of the insulator between the distal and proximal portions. The shoulder is arranged to seat on the seat portion of the housing with an annular packing interposed therebetween. On an inner peripheral surface of the seat portion of the housing which faces an outer peripheral surface of the distal portion of the shoulder, there are formed uneven portions that are arranged in a circumferential direction of the spark plug. Each of the uneven portions consists of a protrusion and a recess that adjoin each other in the circumferential direction.

16 Claims, 14 Drawing Sheets

SPARK PLUG FOR INTERNAL COMBUSTION ENGINE

CROSS-REFERENCE TO RELATED APPLICATIONS

This application is based on and claims priority from Japanese Patent Applications No. 2014-136946 filed on Jul. 2, 2014 and No. 2014-136947 filed on Jul. 2, 2014, the contents of which are hereby incorporated by reference in their entireties into this application.

BACKGROUND

1. Technical Field

The present invention relates to spark plugs for internal combustion engines.

2. Description of the Related Art

As ignition means in internal combustion engines, there are used spark plugs which include a tubular housing, a tubular insulator, a center electrode and a ground electrode. The insulator is retained in the housing. The center electrode is secured in the insulator with a distal end portion of the center electrode protruding outside the insulator. The ground electrode is provided at a distal end of the housing. The ground electrode has a distal end portion that faces the distal end portion of the center electrode in an axial direction of the spark plug through a spark gap formed therebetween. Those spark plugs are configured to discharge a spark across the spark gap, thereby igniting an air-fuel mixture in a combustion chamber of the engine.

For example, Japanese Patent Application Publication No. JP2009176525A discloses a spark plug which has an annular packing interposed between the insulator and the housing (or main metal body). Specifically, the insulator has a surface that is formed on the outer periphery of the insulator so as to face distalward (i.e., toward the distal side). On the other hand, the housing has a surface that is formed on the inner periphery of the housing so as to face proximalward (i.e., toward the proximal side). The annular packing is interposed between the two surfaces of the insulator and the housing. Further, in the spark plug, the positional relationship between a reduced-diameter portion of the housing and the packing is specified, so as to achieve the cleaning effect due to a corona discharge, thereby improving the anti-fouling capability of the spark plug.

In recent years, it has been aimed to further lower the fuel consumption and improve the efficiency of internal combustion engines. As a consequence, in internal combustion engines, the air-fuel mixture is in an environment where it is difficult for the air-fuel mixture to be combusted; and the combustion temperature is lowered. Further, with the lowering of the combustion temperature, it becomes easier for carbon to be produced, in particular by the combustion of the air-fuel mixture during a cold start of the engine, and adhere to the insulator of a spark plug used in the engine.

In the spark plug disclosed in the above patent document, only the positional relationship between the reduced-diameter portion of the housing and the packing is specified. That is, no improvement is made to the structure of the housing or the packing.

Moreover, in the above patent document, it is aimed to achieve the effect of cleaning (i.e., burning off) the carbon adhered to the insulator by causing a corona discharge to occur while suppressing generation of leak current.

However, the magnitude of corona current which flows during a corona discharge is lower than that of leak current. Consequently, in the spark plug disclosed in the above patent document, it may be impossible to sufficiently burn off the carbon adhered to the insulator.

SUMMARY

According to one exemplary embodiment, there is provided a first spark plug for an internal combustion engine. The first spark plug includes a tubular housing, a tubular insulator, a center electrode and a ground electrode. The insulator is retained in the housing. The center electrode is secured in the insulator with a distal end portion of the center electrode protruding outside the insulator. The ground electrode is provided at a distal end of the housing. The ground electrode has a distal end portion that faces the distal end portion of the center electrode in an axial direction of the spark plug through a spark gap formed therebetween. Moreover, in the first spark plug, the housing has a seat portion formed on an inner periphery thereof. The seat portion has a seat surface that faces proximalward. The insulator has a distal portion, a proximal portion that has a larger outer diameter than the distal portion, and a shoulder formed on an outer periphery of the insulator between the distal and proximal portions. The shoulder is arranged to seat on the seat surface of the seat portion of the housing. The first spark plug further includes an annular packing that is interposed between the seat surface of the seat portion of the housing and the shoulder of the insulator. Furthermore, in the first spark plug, on an inner peripheral surface of the seat portion of the housing which faces an outer peripheral surface of the distal portion of the shoulder, there are formed a plurality of uneven portions that are arranged in a circumferential direction of the spark plug. Each of the uneven portions consists of a protrusion and a recess that adjoin each other in the circumferential direction.

Consequently, with the uneven portions formed on the inner peripheral surface of the seat portion of the housing, it is possible to generate leak current between the seat portion of the housing and the outer peripheral surface of the distal portion of the insulator, thereby effectively burning off carbon adhered to the outer peripheral surface of the distal portion of the insulator.

In further implementations of the first spark plug, the uneven portions may be formed on the inner peripheral surface of the seat portion of the housing over an entire axial length of the inner peripheral surface. Alternatively, the uneven portions may be formed on the inner peripheral surface of the seat portion of the housing only in an axial range from a distal end to an axial center position of the inner peripheral surface.

Each of the protrusions of the uneven portions may have a triangular or quadrangular cross section perpendicular to the axial direction of the spark plug.

It is preferable that the protrusions of the uneven portions are arranged in the circumferential direction of the spark plug at an angular pitch in the range of 5 to 30°.

It is also preferable that a gap between the tips of the protrusions of the uneven portions and the outer peripheral surface of the distal portion of the insulator is in the range of 0.05 to 0.4 mm.

The tips of the protrusions of the uneven portions may be rounded so as to have, preferably, a radius of curvature less than or equal to 0.3 mm. Alternatively, the tips of the protrusions of the uneven portions may be chamfered with the chamfering width being, preferably, less than or equal to 0.3 mm.

According to another exemplary embodiment, there is provided a second spark plug for an internal combustion engine. The second spark plug includes a tubular housing, a tubular insulator, a center electrode and a ground electrode. The insulator is retained in the housing. The center electrode is secured in the insulator with a distal end portion of the center electrode protruding outside the insulator. The ground electrode is provided at a distal end of the housing. The ground electrode has a distal end portion that faces the distal end portion of the center electrode in an axial direction of the spark plug through a spark gap formed therebetween. Moreover, in the second spark plug, the housing has a seat portion formed on an inner periphery thereof. The seat portion has a seat surface that faces proximalward. The insulator has a distal portion, a proximal portion that has a larger outer diameter than the distal portion, and a shoulder formed on an outer periphery of the insulator between the distal and proximal portions. The shoulder is arranged to seat on the seat surface of the seat portion of the housing. The second spark plug further includes an annular packing that is interposed between the seat surface of the seat portion of the housing and the shoulder of the insulator. Furthermore, in the second spark plug, on an inner peripheral surface of the packing, there are formed a plurality of uneven portions that are arranged in a circumferential direction of the spark plug. Each of the uneven portions consists of a protrusion and a recess that adjoin each other in the circumferential direction.

Consequently, with the uneven portions formed on the inner peripheral surface of the packing, it is possible to generate leak current between the packing and the outer peripheral surface of the distal portion of the insulator, thereby effectively burning off carbon adhered to the outer peripheral surface of the distal portion of the insulator.

In further implementations of the second spark plug, each of the protrusions of the uneven portions may have a triangular or quadrangular cross section perpendicular to the axial direction of the spark plug.

It is preferable that the protrusions of the uneven portions are arranged in the circumferential direction of the spark plug at an angular pitch in a range of 5 to 30°.

A radially inner end portion of the packing may be bent distalward so that tips of the protrusions of the uneven portions formed on the inner peripheral surface of the packing protrude distalward from a corner edge of the seat portion of the housing. The corner edge is formed between the seat surface and an inner peripheral surface of the seat portion of the housing. In this case, it is preferable that the protruding amount of the tips of the protrusions of the uneven portions from the corner edge of the seat portion of the housing distalward in the axial direction is in the range of 0 to 1 mm.

The tips of the protrusions of the uneven portions may be rounded so as to have, preferably, a radius of curvature less than or equal to 0.3 mm. Alternatively, the tips of the protrusions of the uneven portions may be chamfered with the chamfering width being, preferably, less than or equal to 0.3 mm.

BRIEF DESCRIPTION OF THE DRAWINGS

The present invention will be understood more fully from the detailed description given hereinafter and from the accompanying drawings of exemplary embodiments, which, however, should not be taken to limit the present invention to the specific embodiments but are for the purpose of explanation and understanding only.

In the accompanying drawings.

DESCRIPTION OF EMBODIMENTS

Figure 1:
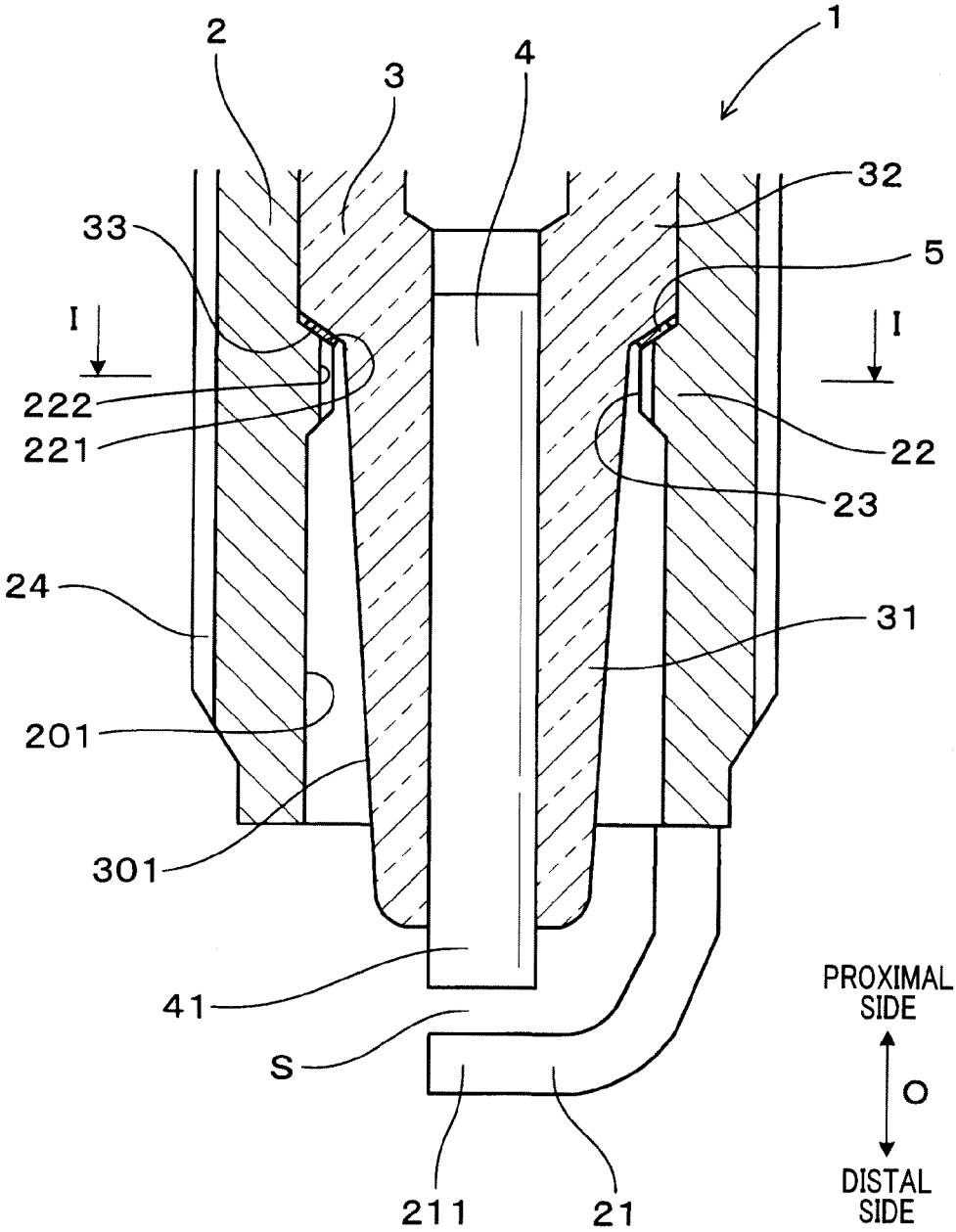
FIG. 1 is a cross-sectional view of a distal part of a spark plug according to a first embodiment.

Exemplary embodiments will be described hereinafter with reference to FIGS. 1-25. It should be noted that for the sake of clarity and understanding, identical components having identical functions throughout the whole description have been marked, where possible, with the same reference numerals in each of the figures.

First Embodiment

This embodiment illustrates a spark plug 1 that is designed to be used as ignition means in an internal combustion engine of, for example, a motor vehicle.

More specifically, the spark plug 1 is designed to ignite an air-fuel mixture in a combustion chamber of the engine. The spark plug 1 has one axial end to be connected to an ignition coil (not shown) and the other axial end to be placed inside the combustion chamber. In addition, hereinafter, as shown in FIG. 1, the axial side where the spark plug 1 is to be connected to the ignition coil will be referred to as "proximal side"; and the other axial side where the spark plug 1 is to be placed inside the combustion chamber will be referred to as "distal side".

As shown in FIG. 1, the spark plug 1 according to the present embodiment includes: a tubular housing (or metal shell) 2; a tubular insulator 3 retained in the housing 2; a center electrode 4 secured in the insulator 3 such that a distal end portion 41 of the center electrode 4 protrudes outside the insulator 3; and a ground electrode 21 provided at a distal end of the housing 2 and having a distal end portion 211 that faces the distal end portion 41 of the center electrode 4 in an axial direction O of the spark plug 1 through a spark gap S formed therebetween.

Figure 2:
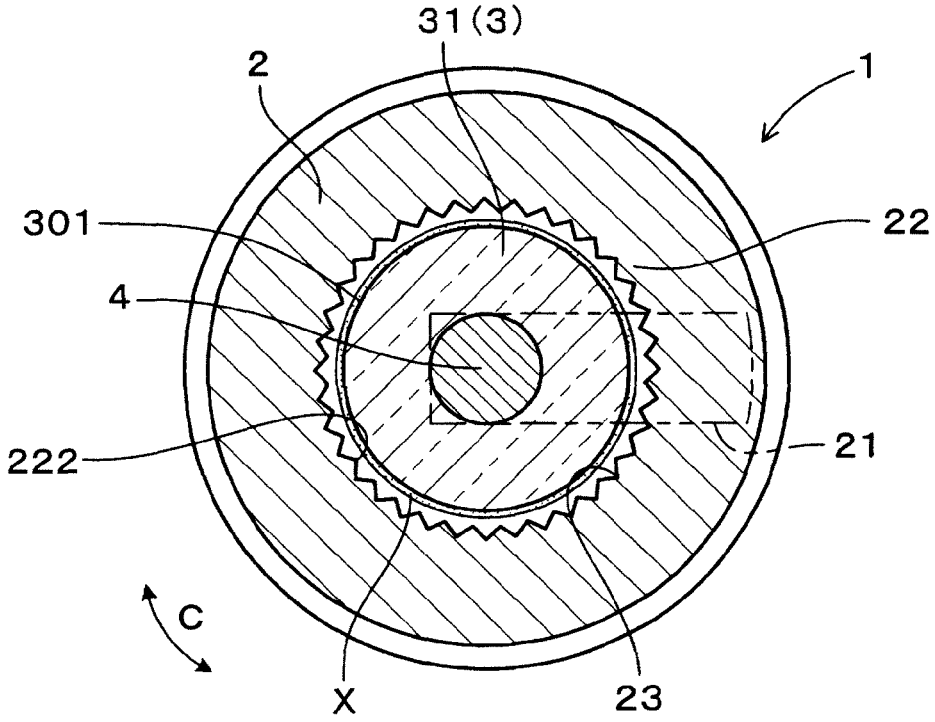
FIG. 2 is a cross-sectional view taken as indicated with the arrows I in FIG. 1.
Figure 3:
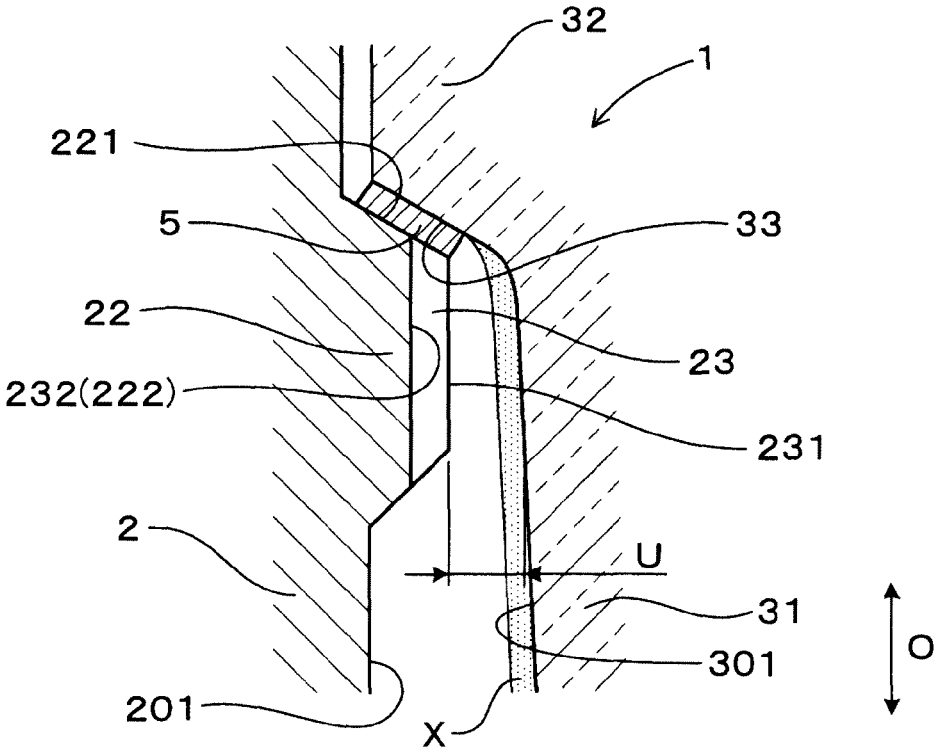
FIG. 3 is an enlarged cross-sectional view, taken along an axial direction of the spark plug, of a seat portion of a housing and its vicinities in the spark plug according to the first embodiment.

Moreover, as shown in FIGS. 1-3, in the present embodiment, the housing 2 has a seat portion 22 that is formed on an inner periphery of the housing 2 by reducing the inner diameter of the housing 2 for a given range in the axial direction O. The seat portion 22 has a seat surface 221 that faces proximalward (i.e., toward the proximal side) and tapers distalward (i.e., toward the distal side). The insulator 3 has a distal portion 31, a proximal portion 32 that has a larger outer diameter than the distal portion 31, and a shoulder 33 formed on an outer periphery of the insulator 3 between the distal and proximal portions 31 and 32. The shoulder 33, which also tapers distalward, is arranged to seat on the seat surface 221 of the seat portion 22 of the housing 2. The spark plug 1 further includes an annular packing 5 that is interposed between the seat surface 221 of the seat portion 22 of the housing 2 and the shoulder 33 of the insulator 3.

Figure 4:
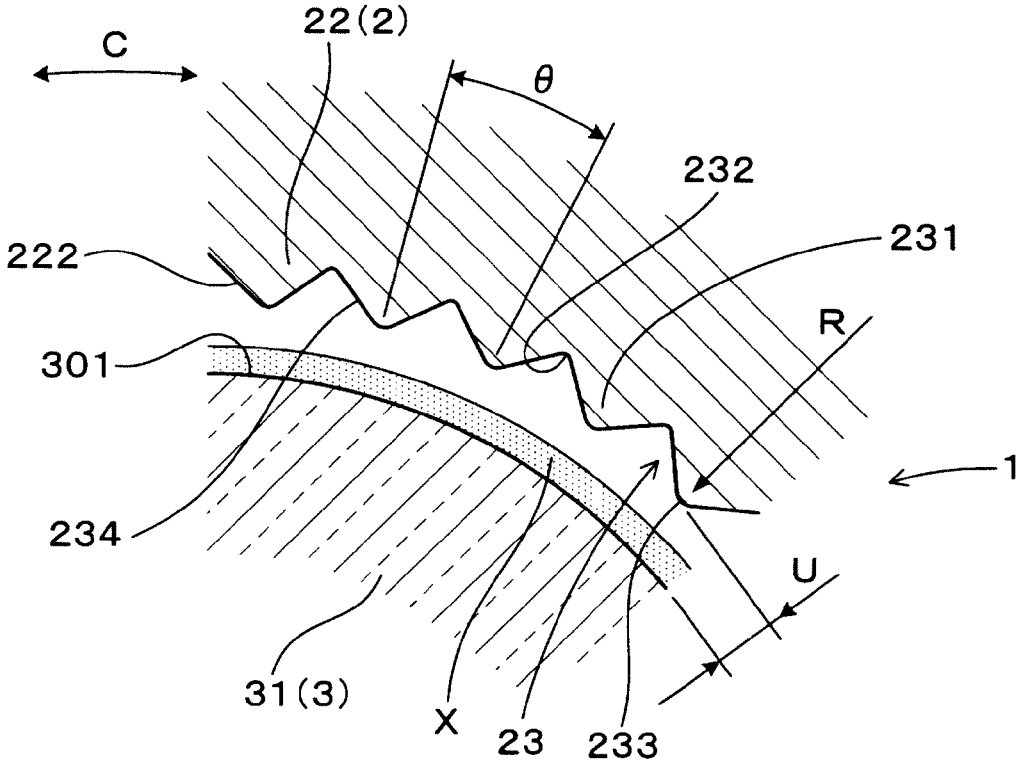
FIG. 4 is an enlarged cross-sectional view, taken perpendicular to the axial direction of the spark plug, of the seat portion of the housing and its vicinities in the spark plug according to the first embodiment.

Furthermore, as shown in FIGS. 2 and 4, in the present embodiment, on an inner peripheral surface 222 of the seat portion 22 of the housing 2 which faces an outer peripheral surface 301 of the distal portion 31 of the insulator 3, there are formed a plurality of uneven portions 23 that are arranged in a circumferential direction C of the spark plug 1 (i.e., circumferential direction of the tubular housing 2). Each of the uneven portions 23 consists of a protrusion 231 and a recess 232 that adjoin each other in the circumferential direction C.

Hereinafter, the configuration of the spark plug 1 according to the present embodiment will be described in detail with reference to FIGS. 1-13.

The spark plug 1 is used in the internal combustion engine with a proximal end of the center electrode 4 connected to a high-voltage terminal (not shown) of the ignition coil and the housing 2 connected to a cylinder head (not shown) of the engine.

On an outer periphery of a distal portion of the housing 2, there is formed a male-threaded portion 24 for being fastened into a female-threaded bore (not shown) formed in the cylinder head.

The ground electrode 21 protrudes from the distal end of the housing 2 and is bent so as to have the distal end portion 211 of the ground electrode 2 face the distal end portion 41 of the center electrode 4 in the axial direction O of the spark plug 1. Between the distal end portion 41 of the center electrode 4 and the distal end portion 211 of the ground electrode 2, there is formed the spark gap G.

As shown in FIGS. 1 and 3, the seat portion 22 of the housing 2 is formed to protrude from the inner periphery of the housing 2 so as to support the shoulder 33 of the insulator 3 from the lower side. Moreover, the seat portion 22 is formed over the entire circumference of the inner periphery of the housing 2, while the shoulder 33 is formed over the entire circumference of the outer periphery of the insulator 3. The seat surface 221 of the seat portion 22 tapers distalward so that the diameter of the seat surface 221 decreases in the distalward direction. Similarly, the shoulder 33 also tapers distalward so that the diameter of the shoulder 33 decreases in the distalward direction.

Moreover, the outer peripheral surface 301 of the distal portion 31 of the insulator 3 also tapers distalward so that the outer diameter of the distal portion 31 decreases in the distalward direction. On the other hand, the inner peripheral surface 201 of the housing 2 on the distal side of the seat portion 22 extends parallel to the axial direction O of the spark plug 1. Consequently, the gap (or air pocket) formed between the inner peripheral surface 201 of the housing 2 on the distal side of the seat portion 22 and the outer peripheral surface 301 of the distal portion 31 of the insulator 3 is gradually widened in the distalward direction. In addition, the distal end portion 41 of the center electrode 4 protrudes from the distal end of the distal part 31 of the insulator 3.

As shown in FIG. 3, in the present embodiment, the uneven portions 23 are formed on the inner peripheral surface 222 of the seat portion 22 of the housing 2 over the entire axial length of the inner peripheral surface 222 of the seat portion 22. Moreover, the depth of the recesses 232 of the uneven portions 23 are kept constant over the entire axial length of the inner peripheral surface 222 of the seat portion 22.

Figure 5:
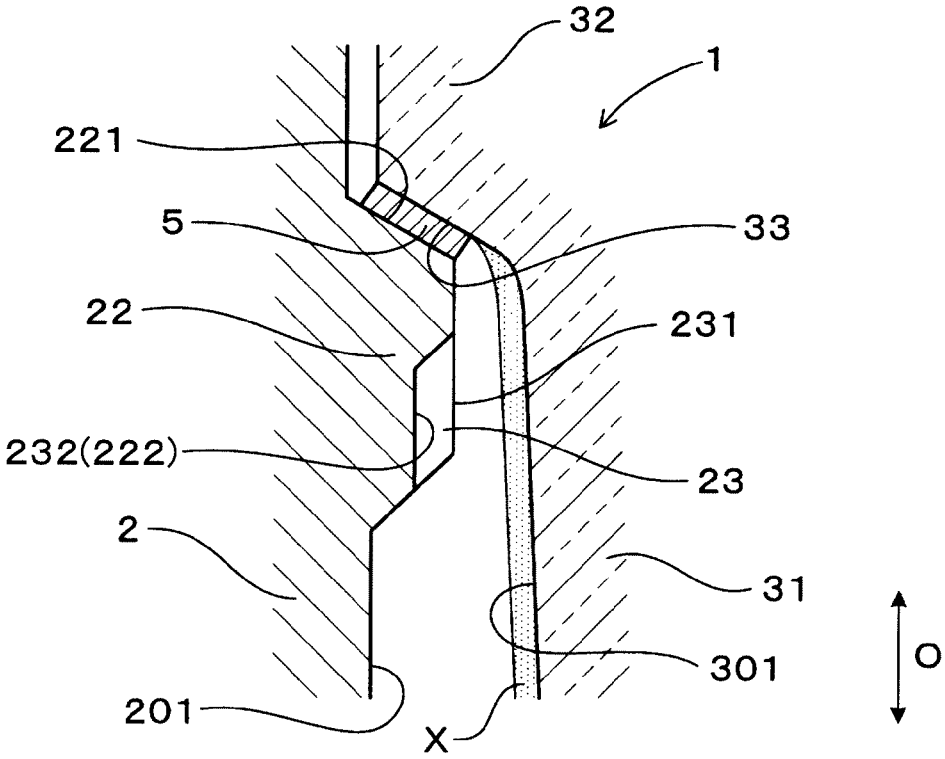
FIG. 5 is an enlarged cross-sectional view illustrating a first modification to the spark plug according to the first embodiment.
Figure 6:
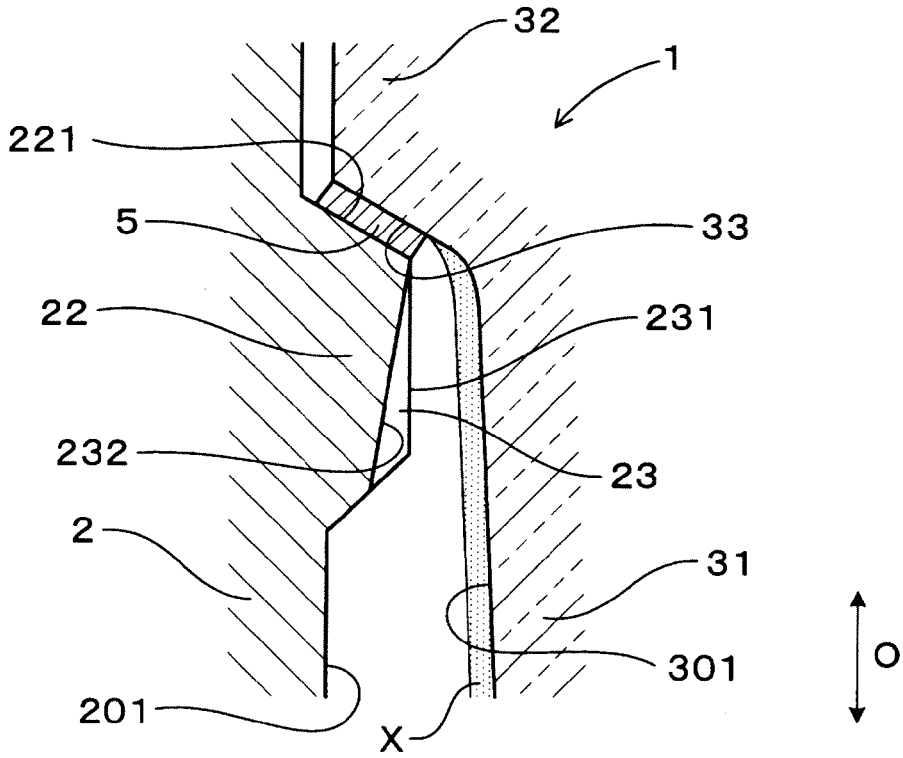
FIG. 6 is an enlarged cross-sectional view illustrating a second modification to the spark plug according to the first embodiment.

In addition, as shown in FIG. 5, the uneven portions 23 may be formed on the inner peripheral surface 222 of the seat portion 22 of the housing 2 only in an axial range from a distal end to an axial center position of the inner peripheral surface 222. In this case, the uneven portions 23 may be obtained by forming grooves in the inner peripheral surface 222 of the seat portion 22. Moreover, as shown in FIG. 6, the depth of the recesses 232 of the uneven portions 23 may be gradually increased in the axial direction O from the proximal end to the distal end of the inner peripheral surface 222 of the seat portion 22.

As shown in FIG. 4, in the present embodiment, each of the protrusions 231 of the uneven portions 23 has a triangular cross section perpendicular to the axial direction O of the spark plug 1. Moreover, a pair of sides 234 of the triangular cross section are formed into a straight line shape.

Figure 7:
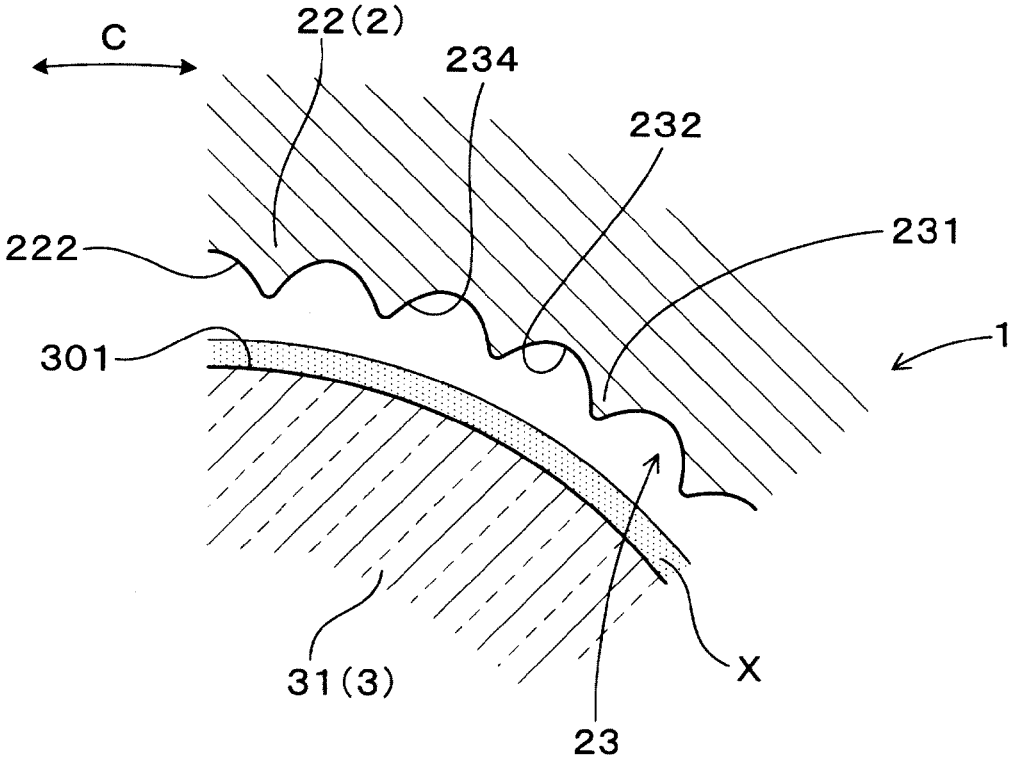
FIG. 7 is an enlarged cross-sectional view illustrating a third modification to the spark plug according to the first embodiment.

In addition, as shown in FIG. 7, for each of the protrusions 231 of the uneven portions 23, the pair of sides 234 of the triangular cross section of the protrusion 231 may be formed into a curved line shape.

It should be noted that with the triangular cross section shown in FIG. 4 or FIG. 7, the gap U between the protrusion 231 and the outer peripheral surface 301 of the distal portion 31 of the insulator 3 is smallest at the radially inner vertex of the triangular cross section.

Figure 8:
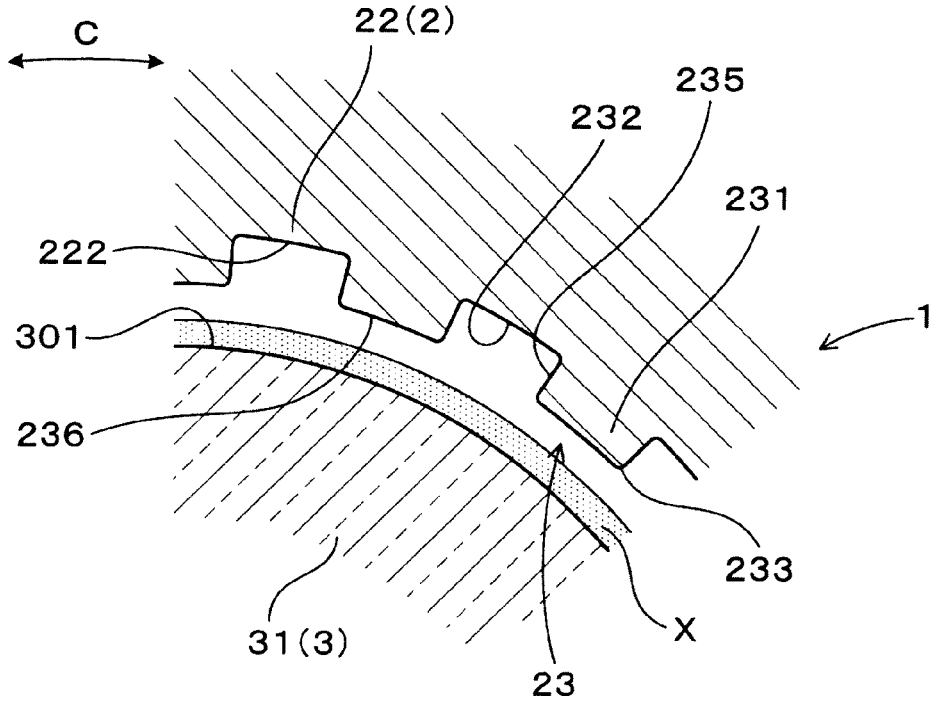
FIG. 8 is an enlarged cross-sectional view illustrating a fourth modification to the spark plug according to the first embodiment.

Furthermore, as shown in FIG. 8, each of the protrusions 231 of the uneven portions 23 may have a quadrangular cross section perpendicular to the axial direction O of the spark plug 1. In this case, a pair of sides 235 of the quadrangular cross section may be formed into either a straight line shape or a curved line shape.

It should be noted that with the quadrangular cross section, the gap U between the protrusion 231 and the outer peripheral surface 301 of the distal portion 31 of the insulator 3 is smallest at the corners 233 of the quadrangular cross section in the circumferential direction C or the inner peripheral side 236 of the quadrangular cross section.

As shown in FIG. 4, in the present embodiment, the protrusions 231 of the uneven portions 23 are arranged in the circumferential direction C of the spark plug 1 at an angular pitch θ in the range of 5 to 30°. Here, the angular pitch θ depends on the number of the protrusions 231 formed on the inner peripheral surface 222 of the seat portion 22 along the circumferential direction C. In addition, depending on the number of the protrusions 231 and the protruding height of the protrusions 231 (or the depth of the recesses 232), the protrusions 231 may be formed into either the shape of an obtuse angle or the shape of an acute angle.

Moreover, as shown in FIG. 4, in the present embodiment, the protrusions 231 of the uneven portions 23 are formed on the inner peripheral surface 222 of the seat portion 22 of the housing 2 so as to adjoin one another in the circumferential direction C of the spark plug 1.

Figure 9:
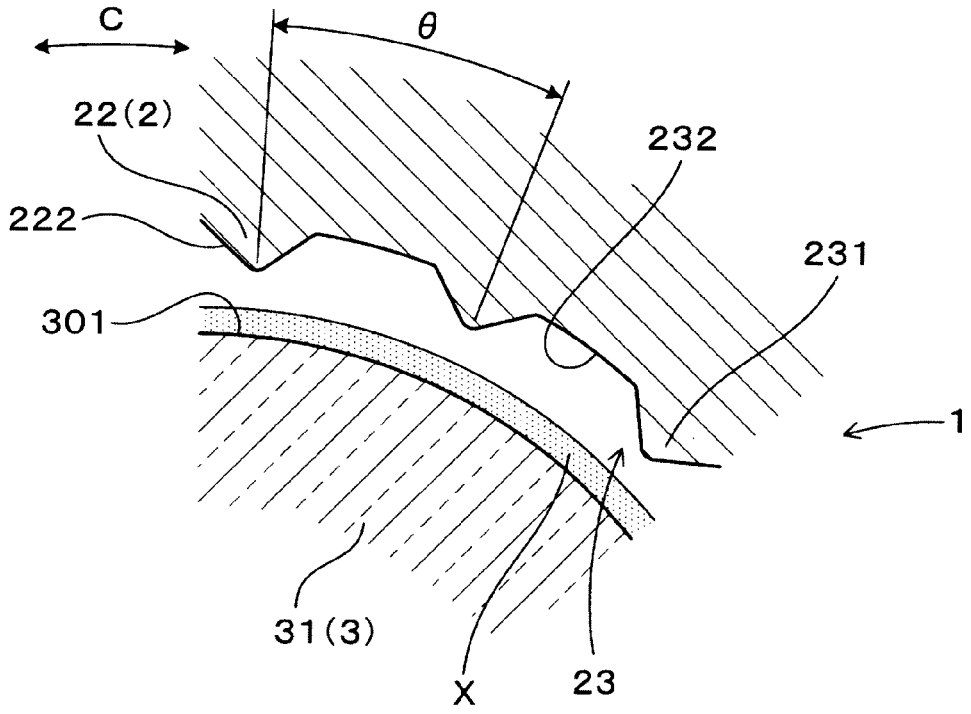
FIG. 9 is an enlarged cross-sectional view illustrating a fifth modification to the spark plug according to the first embodiment.

In addition, as shown in FIG. 9, the protrusions 231 of the uneven portions 23 may be formed on the inner peripheral surface 222 of the seat portion 22 of the housing 2 so as to be separated from one another in the circumferential direction C of the spark plug 1 by the recesses 232 formed therebetween.

Referring to FIGS. 3 and 4, in the present embodiment, the gap U between the tips 233 of the protrusions 231 of the uneven portions 23 formed on the inner peripheral surface 222 of the seat portion 22 of the housing 2 and the outer peripheral surface 301 of the distal portion 31 of the insulator 3 is set to be in the range of 0.05 to 0.4 mm. Moreover, the tips 233 of the protrusions 231 of the uneven portions 23 are rounded so as to have a radius R of curvature less than or equal to 0.3 mm. In addition, the tips 233 of the protrusions 231 of the uneven portions 23 may be alternatively chamfered with the chamfering width being less than or equal to 0.3 mm.

The annular packing 5 is made of a metal material. More particularly, in the present embodiment, the packing 5 is made of a steel sheet by blanking. In addition, the packing 5 may be alternatively made of various other materials which can serve as a cushion member between the housing 2 and the insulator 3.

To determine the effects of the angular pitch θ, the gap U and the radius R of curvature on the performance of the spark plug 1 according to the present embodiment, a fouling test was conducted by the inventor of the present invention, under JIS D1606.

Specifically, sample spark plugs were prepared which had the same basic configuration as the spark plug 1 according to the present embodiment. That is, in each of the sample spark plugs, the protrusions 231 of the uneven portions 23 formed on the inner peripheral surface 222 of the seat portion 22 of the housing 2 had a triangular cross section perpendicular to the axial direction O; and the tips 233 of the protrusions 231 of the uneven portions 23 are rounded. However, the angular pitch θ, the gap U and the radius R of curvature were varied for the sample spark plugs.

Each of the sample spark plugs was tested using a 1.8 L four-cylinder engine. Moreover, for each of the sample spark plugs, the insulation resistance between the housing 2 and the insulator 3 was measured at the end of each cycle; and the number N of cycles repeated until the measured insulation resistance became lower than 10 MΩ was recorded.

The test results are shown in FIGS. 10-13.

Figure 10:
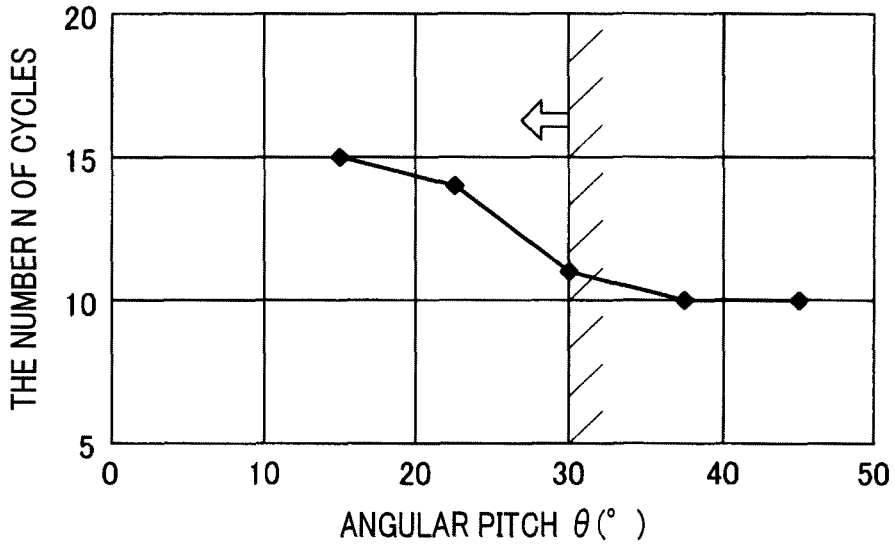
FIG. 10 is a graph illustrating the relationship between an angular pitch and the number of cycles repeated until an insulation resistance became lower than 10 MΩ in a fouling test conducted for the spark plug according to the first embodiment.

Specifically, in FIG. 10, the horizontal axis represents the angular pitch θ between the protrusions 231 of the uneven portions 23 in the circumferential direction C; and the vertical axis represents the number N of cycles repeated until the measured insulation resistance between the housing 2 and the insulator 3 became lower than 10 MΩ.

As seen from FIG. 10, the number N of cycles was greater than 10 when the angular pitch θ was less than or equal to 30°, and decreased to 10 when the angular pitch θ was increased above 30°. Moreover, the number N of cycles was considerably large when the angular pitch θ was less than or equal to 22.5°.

Figure 11:
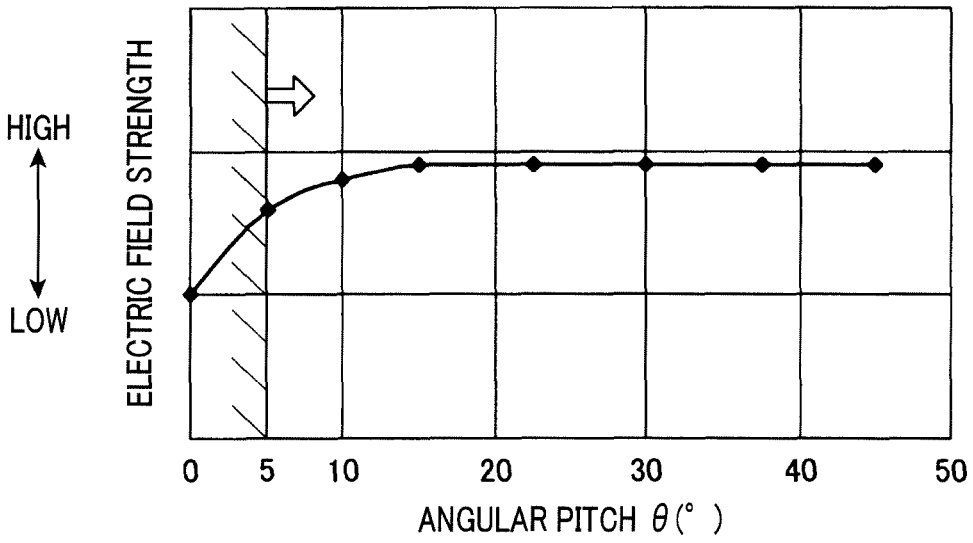
FIG. 11 is a graph illustrating the relationship between the angular pitch and an electric field strength.

On the other hand, as shown in FIG. 11, when the angular pitch θ was too small, interference of electric field occurred between the protrusions 231 of the uneven portions 23; consequently the electric field strength at the protrusions 231 was considerably lowered.

Accordingly, it has been made clear from the above results that the angular pitch θ is preferably set to be in the range of 5 to 30°, and more preferably set to be in the range of 5 to 22.5° in the spark plug 1 according to the present embodiment.

Figure 12:
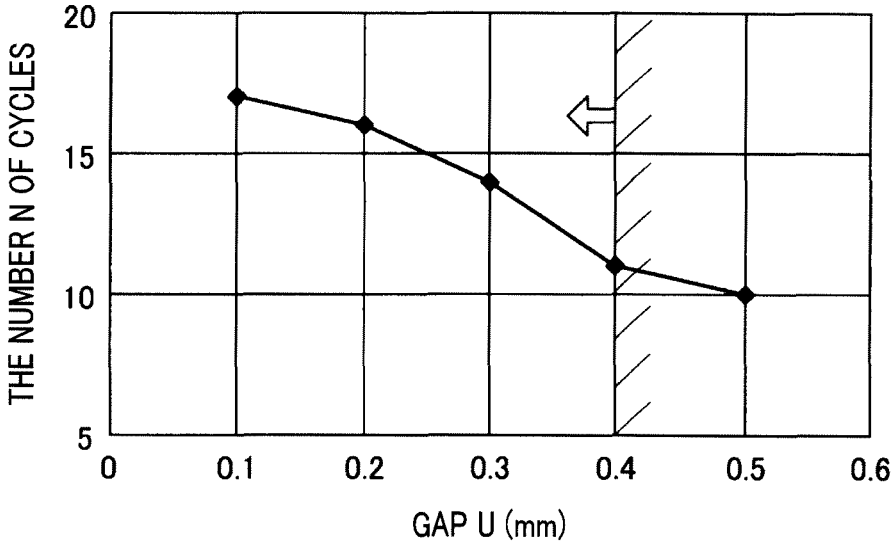
FIG. 12 is a graph illustrating the relationship between a gap and the number of cycles repeated until the insulation resistance became lower than 10 MΩ in the fouling test conducted for the spark plug according to the first embodiment.

In FIG. 12, the horizontal axis represents the gap U between the tips 233 of the protrusions 231 of the uneven portions 23 formed on the inner peripheral surface 222 of the seat portion 22 of the housing 2 and the outer peripheral surface 301 of the distal portion 31 of the insulator 3; and the vertical axis represents the number N of cycles repeated until the measured insulation resistance between the housing 2 and the insulator 3 became lower than 10 MΩ.

As seen from FIG. 12, the number N of cycles was greater than 10 when the gap U was less than or equal to 0.4 mm, and decreased to 10 when the gap U was increased above 0.4 mm. Moreover, the number N of cycles was considerably large when the gap U was less than or equal to 0.3 mm.

In addition, the smaller the gap U, the higher the electric field strength at the protrusions 231 of the uneven portions 23. Therefore, it is preferable to set the gap U as small as possible. On the other hand, to prevent interference between the tips 233 of the protrusions 231 of the uneven portions 23 and the outer peripheral surface 301 of the distal portion 31 of the insulator 3, it is preferable to set the gap U to be greater than or equal to 0.05 mm.

Accordingly, it has been made clear from the above results that the gap U is preferably set to be in the range of 0.05 to 0.4 mm, and more preferably set to be in the range of 0.05 to 0.3 mm in the spark plug 1 according to the present embodiment.

Figure 13:
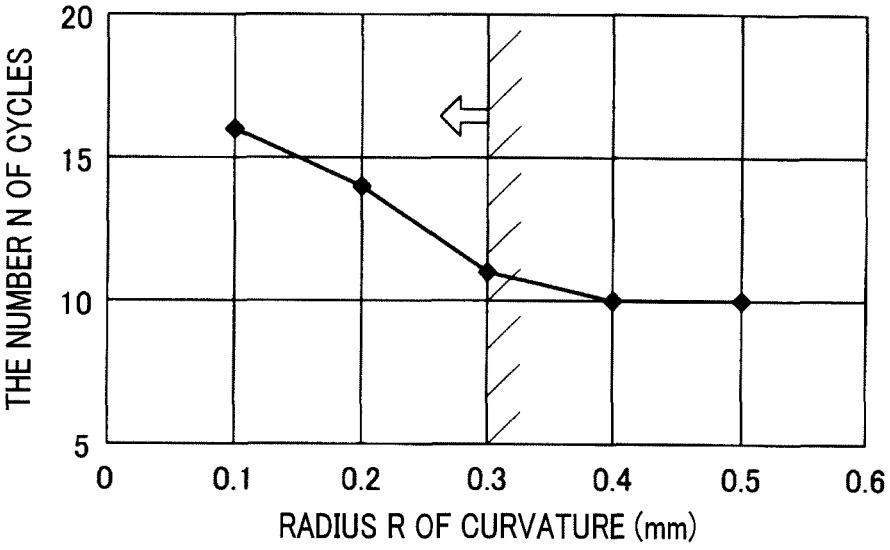
FIG. 13 is a graph illustrating the relationship between a radius of curvature and the number of cycles repeated until the insulation resistance became lower than 10 MΩ in the fouling test conducted for the spark plug according to the first embodiment.

In FIG. 13, the horizontal axis represents the radius R of curvature of the tips 233 of the protrusions 231 of the uneven portions 23 formed on the inner peripheral surface 222 of the seat portion 22 of the housing 2; and the vertical axis represents the number N of cycles repeated until the measured insulation resistance between the housing 2 and the insulator 3 became lower than 10 MΩ.

As seen from FIG. 13, the number N of cycles was greater than 10 when the radius R of curvature was less than or equal to 0.3 mm, and decreased to 10 when the radius R of curvature was increased above 0.3 mm. Moreover, the number N of cycles was considerably large when the radius R of curvature was less than or equal to 0.2 mm.

In addition, the smaller the radius R of curvature, the higher the electric field strength at the protrusions 231 of the uneven portions 23. Therefore, it is preferable to set the radius R of curvature as small as possible. On the other hand, for manufacturing reasons, it may be difficult to make the radius R of curvature less than 0.05 mm.

Accordingly, it has been made clear from the above results that the radius R of curvature is preferably set to be in the range of 0.05 to 0.3 mm, and more preferably set to be in the range of 0.05 to 0.2 mm in the spark plug 1 according to the present embodiment.

Next, advantages of the spark plug 1 according to the present embodiment will be described.

In the spark plug 1 according to the present embodiment, on the inner peripheral surface 222 of the seat portion 22 of the housing 2 which faces the outer peripheral surface 301 of the distal portion 31 of the insulator 3, there are formed the uneven portions 23 that are arranged in the circumferential direction C of the spark plug 1. Each of the uneven portions 23 consists of one protrusion 231 and one recess 232 that adjoin each other in the circumferential direction C. Consequently, with the uneven portions 23, it is possible to generate leak current between the seat portion 22 of the housing 2 and the insulator 3, thereby effectively burning off carbon adhered to the insulator 3.

Specifically, with the uneven portions 23 formed on the inner peripheral surface 222 of the seat portion 22 of the housing 2, the gap between the inner peripheral surface 222 of the seat portion 22 and the outer peripheral surface 301 of the distal portion 31 of the insulator 3 varies in the circumferential direction C. Moreover, with combustion of the air-fuel mixture in the combustion chamber of the engine, carbon comes to adhere to the outer peripheral surface 301 of the distal portion 31 of the insulator 3, as designated by X in FIGS. 2-9. When the gap between the tips 233 of the protrusions 231 of the uneven portions 23 and the carbon X adhered to the outer peripheral surface 301 of the distal portion 31 of the insulator 3 becomes less than or equal to a threshold value, dielectric breakdown occurs due to concentration of electric field on the protrusions 231, causing leak current to flow through the gap. More specifically, any of the tips 233 of the protrusions 231 of the uneven portions 23 serve as a starting point for an electric discharge; and the leak current is generated selectively at any of the protrusions 231. The magnitude of the leak current is tens to hundreds of times higher than that of corona current. As a result, with the leak current flowing between the seat portion 22 of the housing 2 and the outer peripheral surface 301 of the distal portion 31 of the insulator 3, it is possible to effectively burn off the carbon X adhered to the outer peripheral surface 301 of the distal portion 31 of the insulator 3.

In addition, in the case of each of the protrusions 231 of the uneven portions 23 having a triangular cross section as shown in FIG. 4, the leak current is generated at the radially inner vertex of the triangular cross section (i.e., the tip 233); and a portion of the outer peripheral surface 301 of the distal portion 31 of the insulator 3 which faces the radially inner vertex of the triangular cross section serves as a starting point for burning off the carbon X.

On the other hand, in the case of each of the protrusions 231 of the uneven portions 23 having a quadrangular cross section as shown in FIG. 8, the leak current is generated at the corners of the quadrangular cross section in the circumferential direction C (or the tips 233); and portions of the outer peripheral surface 301 of the distal portion 31 of the insulator 3 which face the corners of the quadrangular cross section serve as a starting point for burning off the carbon X.

Second Embodiment

Figure 14:
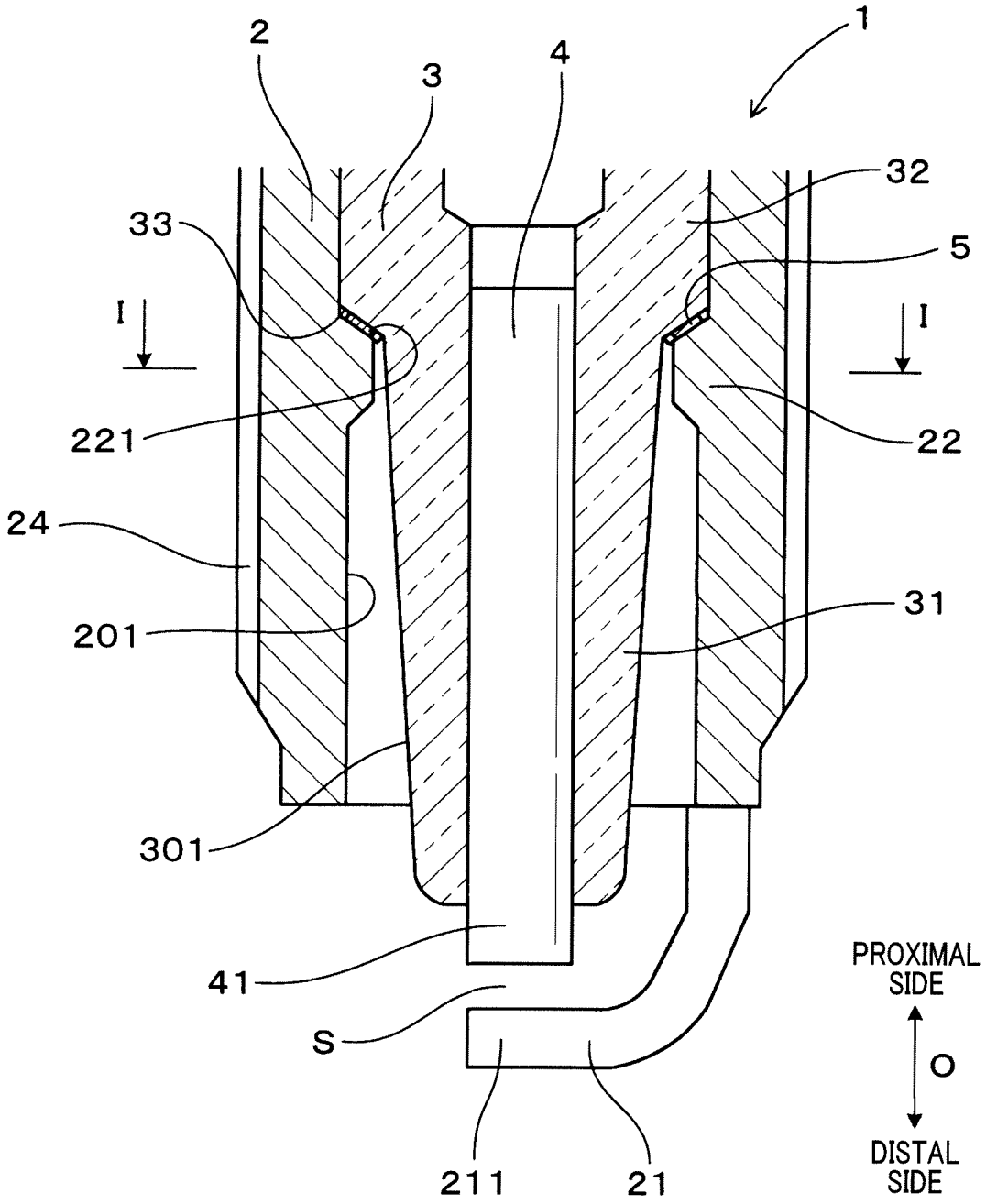
FIG. 14 is a cross-sectional view of a distal part of a spark plug according to a second embodiment.

FIG. 14 shows the overall configuration of a spark plug 1 according to the second embodiment. The spark plug 1 is designed to be used as ignition means in an internal combustion engine of, for example, a motor vehicle.

As shown in FIG. 14, the spark plug 1 according to the present embodiment includes: a tubular housing 2; a tubular insulator 3 retained in the housing 2; a center electrode 4 secured in the insulator 3 such that a distal end portion 41 of the center electrode 4 protrudes outside the insulator 3; and a ground electrode 21 provided at a distal end of the housing 2 and having a distal end portion 211 that faces the distal end portion 41 of the center electrode 4 in an axial direction O of the spark plug 1 through a spark gap S formed therebetween.

Figure 15:
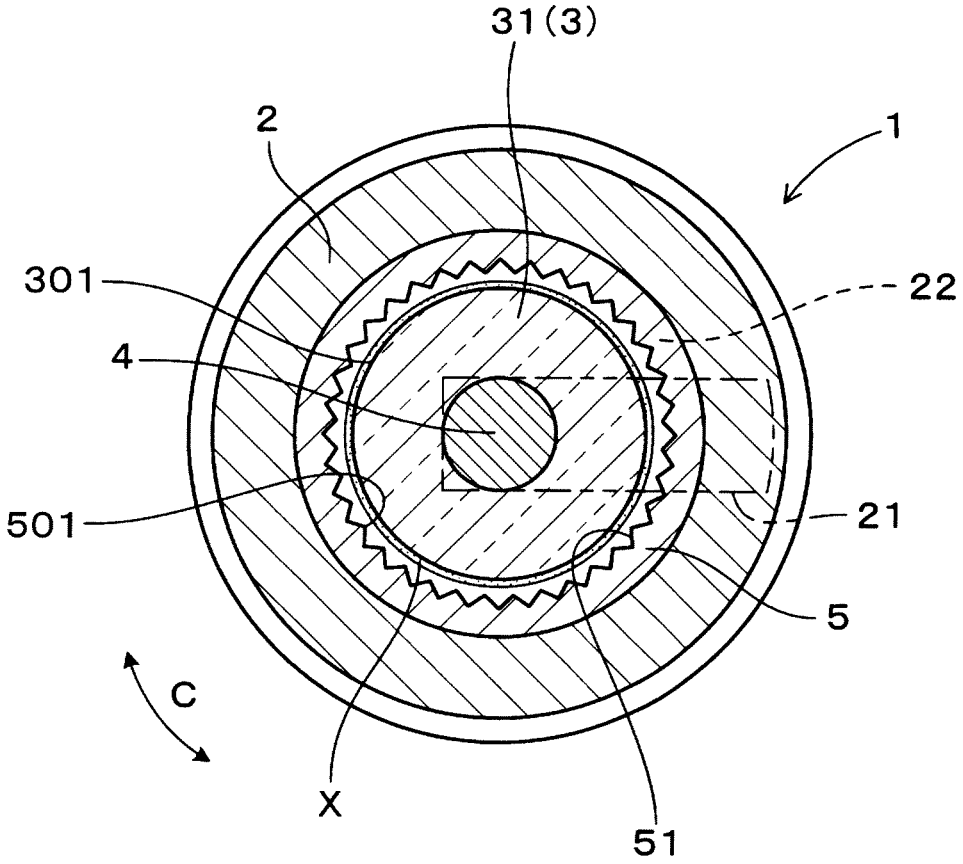
FIG. 15 is a cross-sectional view taken as indicated with the arrows I in FIG. 14.
Figure 16:
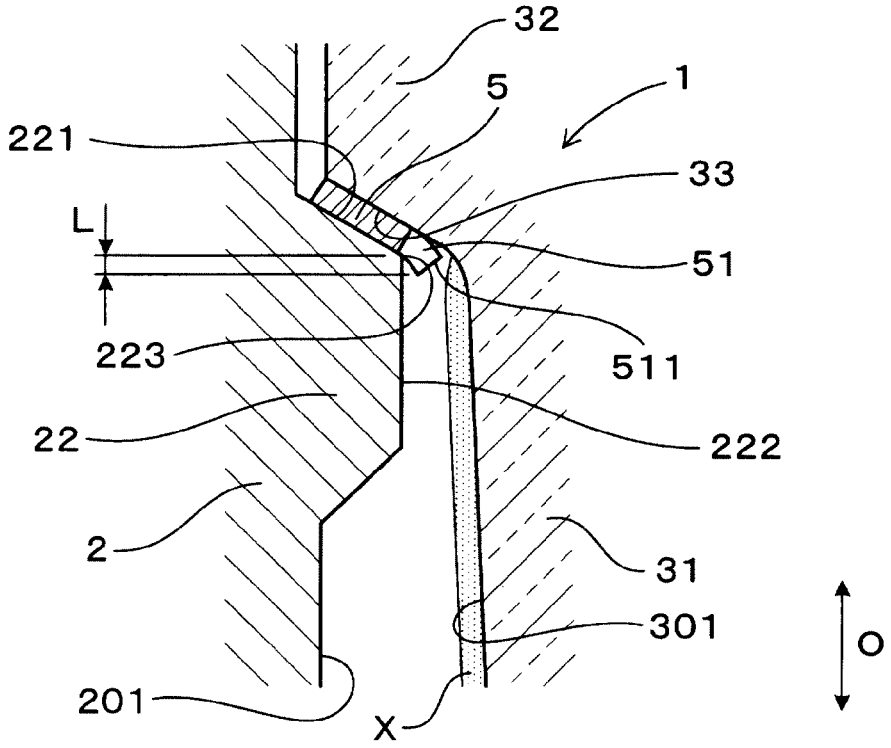
FIG. 16 is an enlarged cross-sectional view, taken along an axial direction of the spark plug, of a packing and its vicinities in the spark plug according to the second embodiment.

Moreover, as shown in FIGS. 14-16, in the present embodiment, the housing 2 has a seat portion 22 that is formed on an inner periphery of the housing 2 by reducing the inner diameter of the housing 2 for a given range in the axial direction O. The seat portion 22 has a seat surface 221 that faces proximalward and tapers distalward. The insulator 3 has a distal portion 31, a proximal portion 32 that has a larger outer diameter than the distal portion 31, and a shoulder 33 formed on an outer periphery of the insulator 3 between the distal and proximal portions 31 and 32. The shoulder 33, which also tapers distalward, is arranged to seat on the seat surface 221 of the seat portion 22 of the housing 2. The spark plug 1 further includes an annular packing 5 that is interposed between the seat surface 221 of the seat portion 22 of the housing 2 and the shoulder 33 of the insulator 3.

Figure 17:
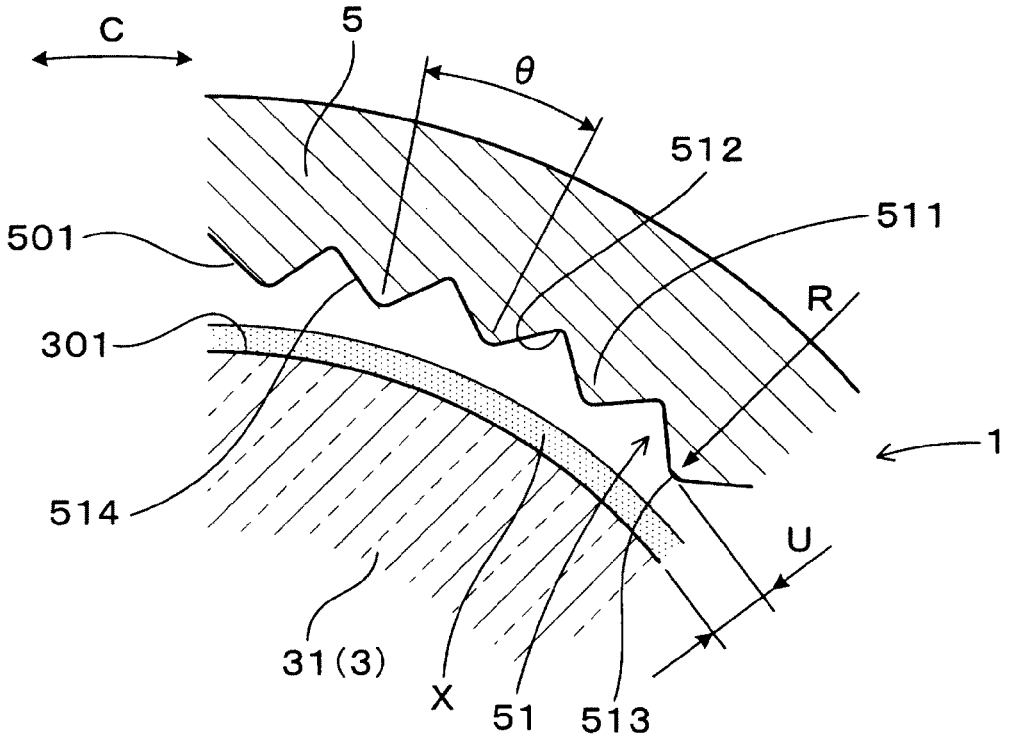
FIG. 17 is an enlarged cross-sectional view, taken perpendicular to the axial direction of the spark plug, of the packing and its vicinities in the spark plug according to the second embodiment.

Furthermore, as shown in FIGS. 15 and 17, in the present embodiment, on an inner peripheral surface 501 of the annular packing 5, there are formed a plurality of uneven portions 51 that are arranged in a circumferential direction C of the spark plug 1 (i.e., circumferential direction of the tubular housing 2). Each of the uneven portions 51 consists of a protrusion 511 and a recess 512 that adjoin each other in the circumferential direction C.

In addition, in the spark plug 1, the packing 5 is actually in a state such that a radially inner end portion of the packing 5 is deformed (or bent) distalward (see FIG. 16). However, for the sake of simplicity and ease of understanding, in FIGS. 15 and 17, the packing 5 is depicted as being in an undeformed state.

Hereinafter, the configuration of the spark plug 1 according to the present embodiment will be described in detail with reference to FIGS. 14-25.

The spark plug 1 is used in the internal combustion engine with a proximal end of the center electrode 4 connected to a high-voltage terminal (not shown) of an ignition coil and the housing 2 connected to a cylinder head (not shown) of the engine.

On an outer periphery of a distal portion of the housing 2, there is formed a male-threaded portion 24 for being fastened into a female-threaded bore (not shown) formed in the cylinder head.

The ground electrode 21 protrudes from the distal end of the housing 2 and is bent so as to have the distal end portion 211 of the ground electrode 2 face the distal end portion 41 of the center electrode 4 in the axial direction O of the spark plug 1. Between the distal end portion 41 of the center electrode 4 and the distal end portion 211 of the ground electrode 2, there is formed the spark gap G.

As shown in FIGS. 14 and 16, the seat portion 22 of the housing 2 is formed to protrude from the inner periphery of the housing 2 so as to support the shoulder 33 of the insulator 3 from the lower side. Moreover, the seat portion 22 is formed over the entire circumference of the inner periphery of the housing 2, while the shoulder 33 is formed over the entire circumference of the outer periphery of the insulator 3. The seat surface 221 of the seat portion 22 tapers distalward so that the diameter of the seat surface 221 decreases in the distalward direction. Similarly, the shoulder 33 also tapers distalward so that the diameter of the shoulder 33 decreases in the distalward direction.

Moreover, the outer peripheral surface 301 of the distal portion 31 of the insulator 3 also tapers distalward so that the outer diameter of the distal portion 31 decreases in the distalward direction. On the other hand, the inner peripheral surface 201 of the housing 2 on the distal side of the seat portion 22 extends parallel to the axial direction O of the spark plug 1. Consequently, the gap (or air pocket) formed between the inner peripheral surface 201 of the housing 2 on the distal side of the seat portion 22 and the outer peripheral surface 301 of the distal portion 31 of the insulator 3 is gradually widened in the distalward direction. In addition, the distal end portion 41 of the center electrode 4 protrudes from the distal end of the distal part 31 of the insulator 3.

The annular packing 5 is made of an electrically-conductive metal material. More particularly, in the present embodiment, the packing 5 is made of a steel sheet by blanking. In addition, the packing 5 may be alternatively made of various other electrically-conductive materials which can serve as a cushion member between the housing 2 and the insulator 3.

As shown in FIG. 16, in the present embodiment, the radially inner end portion of the packing 5 is bent distalward so that the tips of the protrusions 511 of the uneven portions 51 formed on the inner peripheral surface 501 of the packing 5 protrude distalward from a corner edge 223 of the seat portion 22 of the housing 2. Here, the corner edge 223 is formed between the seat surface 221 and an inner peripheral surface 222 of the seat portion 22 of the housing 2. Moreover, in the present embodiment, the protruding amount L of the tips of the protrusions 511 of the uneven portions 51 from the corner edge 223 of the seat portion 22 of the housing 2 distalward in the axial direction O is set to be in the range of 0 to 1 mm. In addition, the protruding amount L being equal to 0 mm indicates that the tips of the protrusions 511 of the uneven portions 51 are axially located just at the corner edge 223 of the seat portion 22 of the housing 2.

The amount by which the radially inner end portion of the packing 5 is bent distalward depends on: the amount by which the radially inner end portion of the packing 5 protrudes from the corner edge 223 of the seat portion 22 of the housing 2; the size of the gap between the inner peripheral surface 222 of the seat portion 22 of the housing 2 and the outer peripheral surface 301 of the distal portion 31 of the insulator 3; and the relation between the size of the gap and the thickness of the packing 5.

For example, as shown in FIG. 16, when the size of the gap between the inner peripheral surface 222 of the seat portion 22 of the housing 2 and the outer peripheral surface 301 of the distal portion 31 of the insulator 3 is considerably greater than the thickness of the packing 5, the radially inner end portion of the packing 5 is bent distalward by a small amount. In this case, the gap between the uneven portions 51 formed on the inner peripheral surface 501 of the packing 5 and the outer peripheral surface 301 of the distal portion 31 of the insulator 3 varies in the circumferential direction C.

Figure 18:
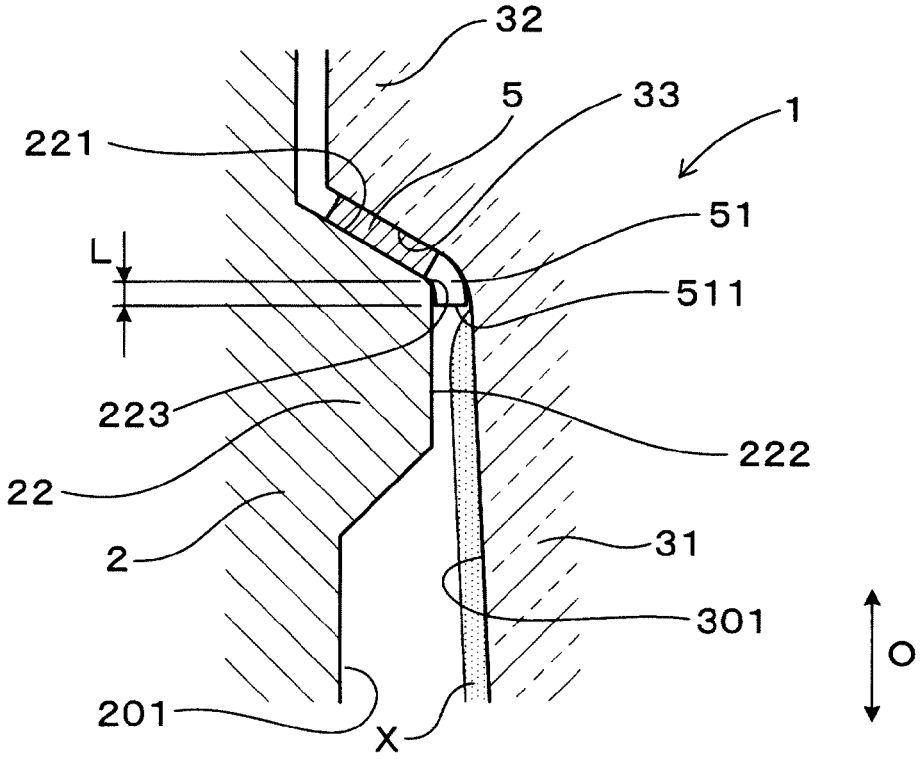
FIG. 18 is an enlarged cross-sectional view illustrating a first modification to the spark plug according to the second embodiment.

On the other hand, as shown in FIG. 18, when the size of the gap between the inner peripheral surface 222 of the seat portion 22 of the housing 2 and the outer peripheral surface 301 of the distal portion 31 of the insulator 3 is close to the thickness of the packing 5, the radially inner end portion of the packing 5 is bent distalward by such a large amount as to extend along the inner peripheral surface 222 of the seat portion 22. In this case, the axial positions (more specifically, the distal end positions) of the uneven portions 51 formed on the inner peripheral surface 501 of the packing 5 vary in the circumferential direction C.

As shown in FIG. 17, in the present embodiment, each of the protrusions 511 of the uneven portions 51 formed on the inner peripheral surface 501 of the packing 5 has a triangular cross section perpendicular to the axial direction O of the spark plug 1. Moreover, a pair of sides 514 of the triangular cross section are formed into a straight line shape.

Figure 19:
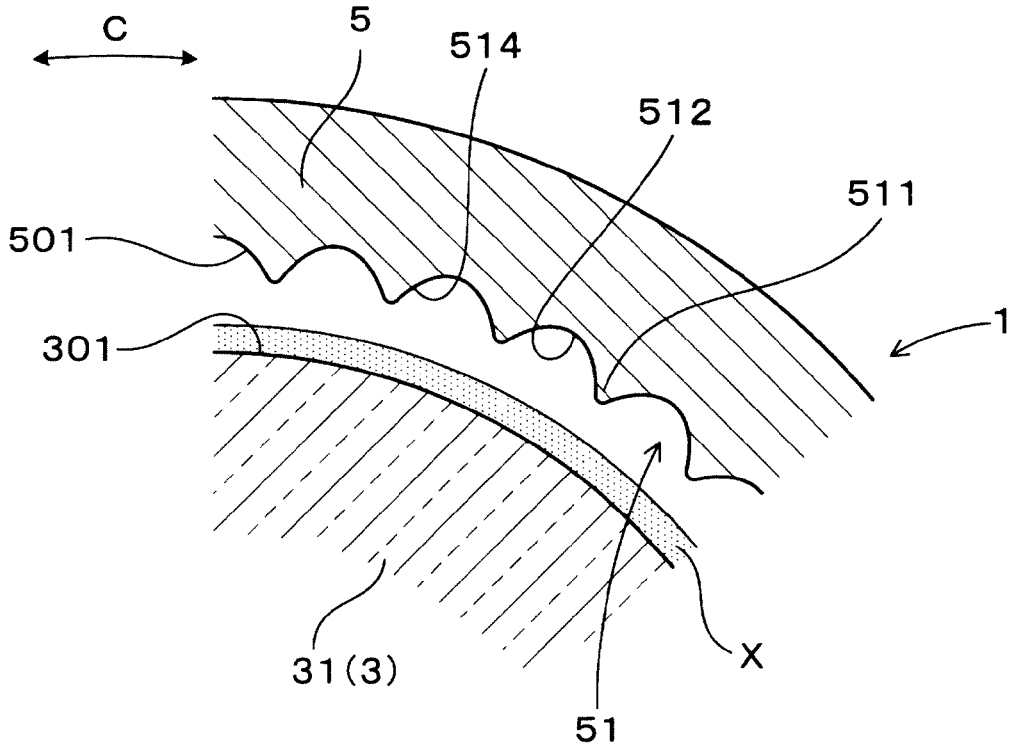
FIG. 19 is an enlarged cross-sectional view illustrating a second modification to the spark plug according to the second embodiment.

In addition, as shown in FIG. 19, for each of the protrusions 511 of the uneven portions 51, the pair of sides 514 of the triangular cross section of the protrusion 511 may be formed into a curved line shape.

It should be noted that: with the triangular cross section shown in FIG. 17 or FIG. 19, the protruding amount L of the protrusion 511 is largest at the radially inner vertex of the triangular cross section; and the gap U between the protrusion 511 and the outer peripheral surface 301 of the distal portion 31 of the insulator 3 is smallest at the radially inner vertex of the triangular cross section.

Figure 20:
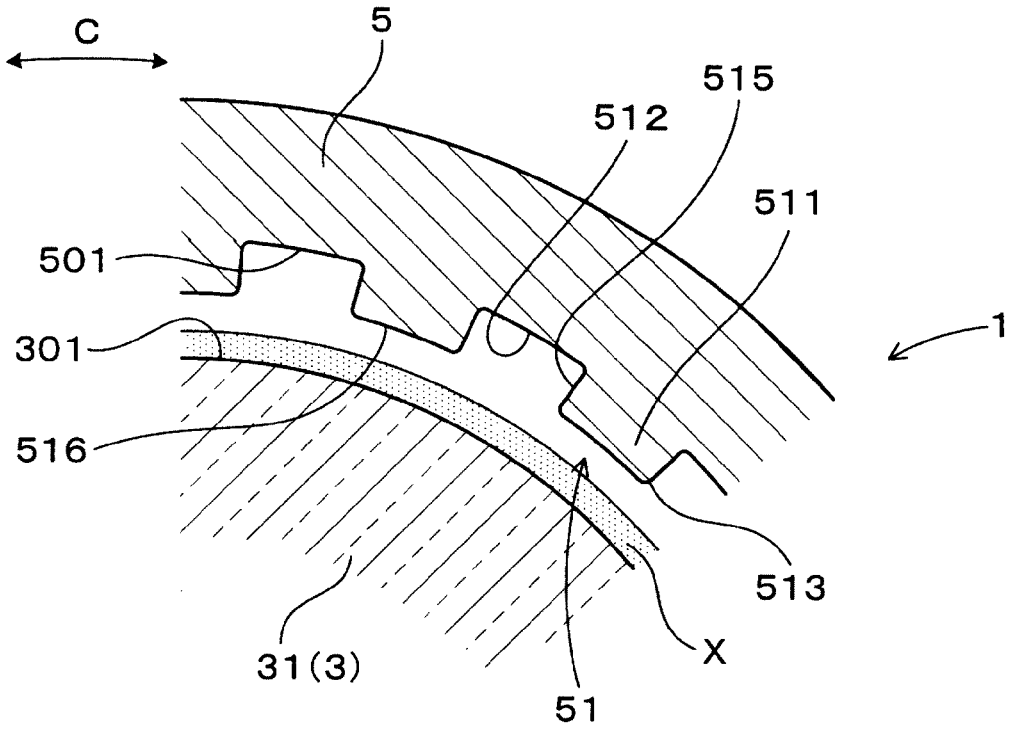
FIG. 20 is an enlarged cross-sectional view illustrating a third modification to the spark plug according to the second embodiment.

Furthermore, as shown in FIG. 20, each of the protrusions 511 of the uneven portions 51 formed on the inner peripheral surface 501 of the packing 5 may have a quadrangular cross section perpendicular to the axial direction O of the spark plug 1. In this case, a pair of sides 515 of the quadrangular cross section may be formed into either a straight line shape or a curved line shape.

It should be noted that: with the quadrangular cross section, the protruding amount L of the protrusion 511 is largest at the corners 513 of the quadrangular cross section in the circumferential direction C or the inner peripheral side 516 of the quadrangular cross section; and the gap U between the protrusion 511 and the outer peripheral surface 301 of the distal portion 31 of the insulator 3 is smallest at the corners 513 or the inner peripheral side 516 of the quadrangular cross section.

As shown in FIG. 17, in the present embodiment, the protrusions 511 of the uneven portions 51 are arranged in the circumferential direction C of the spark plug 1 at an angular pitch θ in the range of 5 to 30°. Here, the angular pitch θ depends on the number of the protrusions 511 formed on the inner peripheral surface 501 of the packing 5 along the circumferential direction C. In addition, depending on the number of the protrusions 511 and the protruding height of the protrusions 511 (or the depth of the recesses 512), the protrusions 511 may be formed into either the shape of an obtuse angle or the shape of an acute angle.

Moreover, as shown in FIG. 17, in the present embodiment, the protrusions 511 of the uneven portions 51 are formed on the inner peripheral surface 501 of the packing 5 so as to adjoin one another in the circumferential direction C of the spark plug 1.

Figure 21:
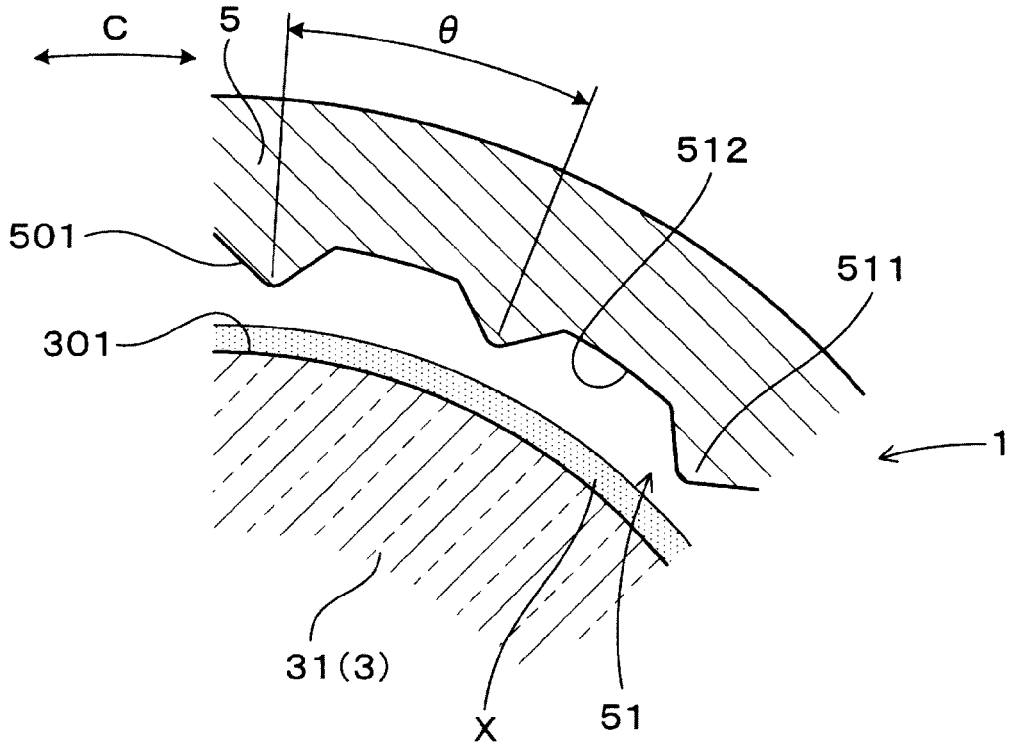
FIG. 21 is an enlarged cross-sectional view illustrating a fourth modification to the spark plug according to the second embodiment.

In addition, as shown in FIG. 21, the protrusions 511 of the uneven portions 51 may be formed on the inner peripheral surface 501 of the packing 5 so as to be separated from one another in the circumferential direction C of the spark plug 1 by the recesses 512 formed therebetween.

Moreover, as shown in FIG. 17, in the present embodiment, the tips 513 of the protrusions 511 of the uneven portions 51 are rounded so as to have a radius R of curvature less than or equal to 0.3 mm. In addition, the tips 513 of the protrusions 511 of the uneven portions 51 may be alternatively chamfered with the chamfering width being less than or equal to 0.3 mm.

To determine the effects of the angular pitch θ, the protruding amount L and the radius R of curvature on the performance of the spark plug 1 according to the present embodiment, a fouling test was conducted by the inventor of the present invention, under JIS D1606.

Specifically, sample spark plugs were prepared which had the same basic configuration as the spark plug 1 according to the present embodiment. That is, in each of the sample spark plugs, the protrusions 511 of the uneven portions 51 formed on the inner peripheral surface 501 of the packing 5 had a triangular cross section perpendicular to the axial direction O; and the tips 513 of the protrusions 511 of the uneven portions 51 are rounded. However, the angular pitch θ, the protruding amount L and the radius R of curvature were varied for the sample spark plugs.

Each of the sample spark plugs was tested using a 1.8 L four-cylinder engine. Moreover, for each of the sample spark plugs, the insulation resistance between the housing 2 and the insulator 3 was measured at the end of each cycle; and the number N of cycles repeated until the measured insulation resistance became lower than 10 MΩ was recorded.

The test results are shown in FIGS. 22-25.

Figure 22:
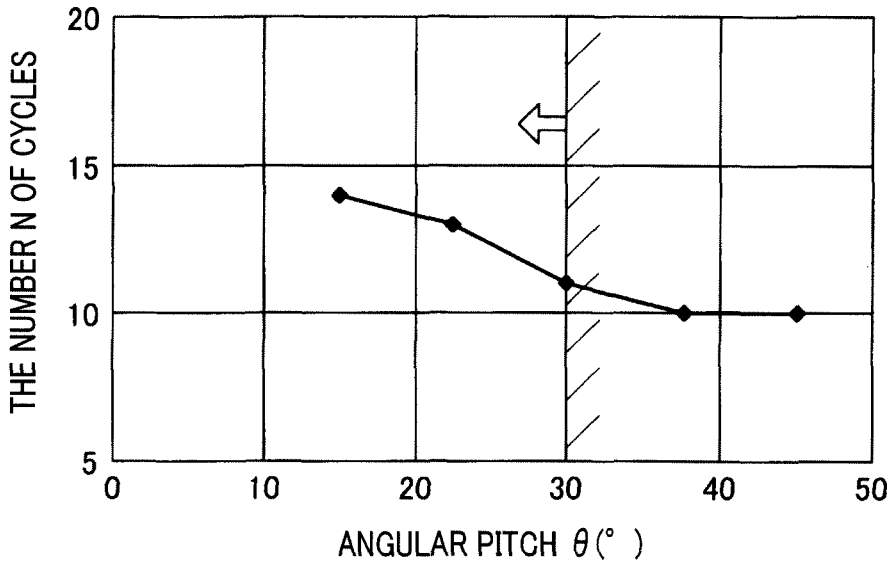
FIG. 22 is a graph illustrating the relationship between an angular pitch and the number of cycles repeated until an insulation resistance became lower than 10 MΩ in a fouling test conducted for the spark plug according to the second embodiment.

Specifically, in FIG. 22, the horizontal axis represents the angular pitch θ between the protrusions 511 of the uneven portions 51 in the circumferential direction C; and the vertical axis represents the number N of cycles repeated until the measured insulation resistance between the housing 2 and the insulator 3 became lower than 10 MΩ.

As seen from FIG. 22, the number N of cycles was greater than 10 when the angular pitch θ was less than or equal to 30°, and decreased to 10 when the angular pitch θ was increased above 30°. Moreover, the number N of cycles was considerably large when the angular pitch θ was less than or equal to 22.5°.

Figure 23:
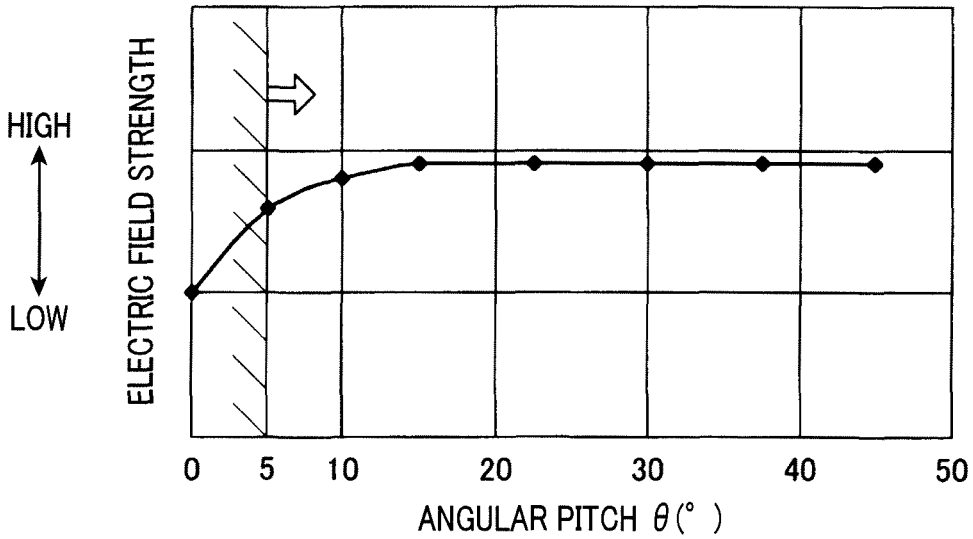
FIG. 23 is a graph illustrating the relationship between the angular pitch and an electric field strength.

On the other hand, as shown in FIG. 23, when the angular pitch θ was too small, interference of electric field occurred between the protrusions 511 of the uneven portions 51; consequently the electric field strength at the protrusions 511 was considerably lowered.

Accordingly, it has been made clear from the above results that the angular pitch θ is preferably set to be in the range of 5 to 30°, and more preferably set to be in the range of 5 to 22.5° in the spark plug 1 according to the present embodiment.

Figure 24:
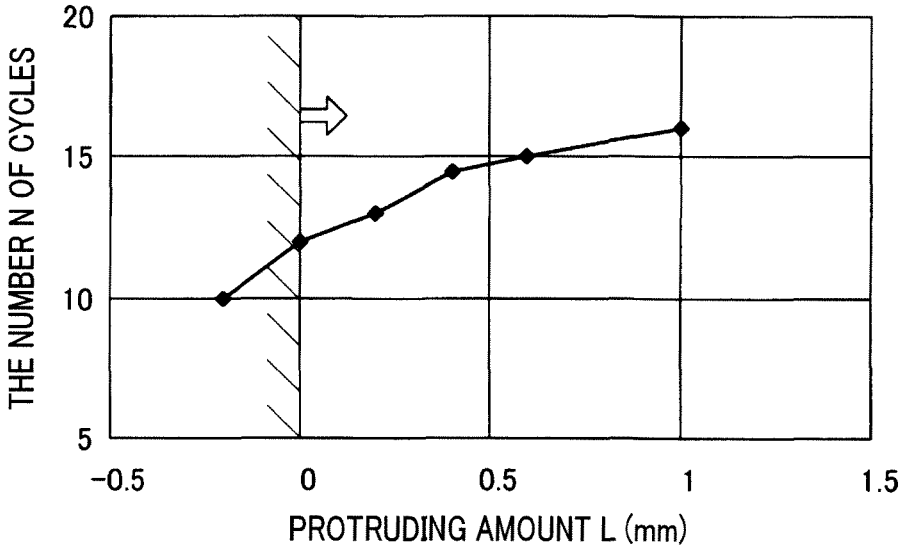
FIG. 24 is a graph illustrating the relationship between a protruding amount and the number of cycles repeated until the insulation resistance became lower than 10 MΩ in the fouling test conducted for the spark plug according to the second embodiment.

In FIG. 24, the horizontal axis represents the protruding amount L of the tips 513 of the protrusions 511 of the uneven portions 51 from the corner edge 223 of the seat portion 22 of the housing 2 distalward in the axial direction O; and the vertical axis represents the number N of cycles repeated until the measured insulation resistance between the housing 2 and the insulator 3 became lower than 10 MΩ.

As seen from FIG. 24, the number N of cycles was greater than 10 when the protruding amount L was greater than or equal to 0 mm, and decreased to 10 when the protruding amount L was decreased below 0 mm (i e, the tips 513 of the protrusions 511 were recessed proximalward from the corner edge 223).

On the other hand, if the protruding amount L was greater than 1 mm, during the assembly of the spark plug 1, the packing 5 might apply excessive pressure to the insulator 3, thereby causing cracks to occur in the insulator 3.

Figure 25:
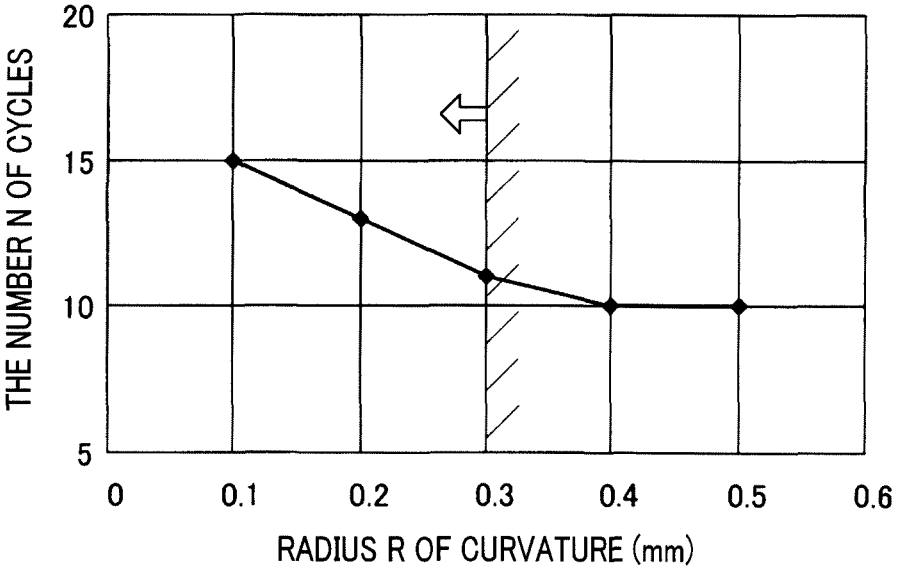
FIG. 25 is a graph illustrating the relationship between a radius of curvature and the number of cycles repeated until the insulation resistance became lower than 10 MΩ in the fouling test conducted for the spark plug according to the second embodiment.

Accordingly, it has been made clear from the above results that the protruding amount L is preferably set to be in the range of 0 to 1 mm. In FIG. 25, the horizontal axis represents the radius R of curvature of the tips 513 of the protrusions 511 of the uneven portions 51 formed on the inner peripheral surface 501 of the packing 5; and the vertical axis represents the number N of cycles repeated until the measured insulation resistance between the housing 2 and the insulator 3 became lower than 10 MΩ.

As seen from FIG. 25, the number N of cycles was greater than 10 when the radius R of curvature was less than or equal to 0.3 mm, and decreased to 10 when the radius R of curvature was increased above 0.3 mm. Moreover, the number N of cycles was considerably large when the radius R of curvature was less than or equal to 0.2 mm.

In addition, the smaller the radius R of curvature, the higher the electric field strength at the protrusions 511 of the uneven portions 51. Therefore, it is preferable to set the radius R of curvature as small as possible. On the other hand, for manufacturing reasons, it may be difficult to make the radius R of curvature less than 0.05 mm.

Accordingly, it has been made clear from the above results that the radius R of curvature is preferably set to be in the range of 0.05 to 0.3 mm, and more preferably set to be in the range of 0.05 to 0.2 mm in the spark plug 1 according to the present embodiment.

Next, advantages of the spark plug 1 according to the present embodiment will be described.

In the spark plug 1 according to the present embodiment, on the inner peripheral surface 501 of the annular packing 5, there are formed the uneven portions 51 that are arranged in the circumferential direction C of the spark plug 1. Each of the uneven portions 51 consists of one protrusion 511 and one recess 512 that adjoin each other in the circumferential direction C. Consequently, with the uneven portions 51, it is possible to generate leak current between the packing 5 and the insulator 3, thereby effectively burning off carbon adhered to the insulator 3.

Specifically, as shown in FIG. 16, when the size of the gap between the inner peripheral surface 222 of the seat portion 22 of the housing 2 and the outer peripheral surface 301 of the distal portion 31 of the insulator 3 is considerably greater than the thickness of the packing 5, the gap between the uneven portions 51 formed on the inner peripheral surface 501 of the packing 5 and the outer peripheral surface 301 of the distal portion 31 of the insulator 3 varies in the circumferential direction C. Moreover, with combustion of the air-fuel mixture in the combustion chamber of the engine, carbon comes to adhere to the outer peripheral surface 301 of the distal portion 31 of the insulator 3, as designated by X in FIGS. 15-21. When the radial gap between the tips 513 of the protrusions 511 of the uneven portions 51 and the carbon X adhered to the outer peripheral surface 301 of the distal portion 31 of the insulator 3 becomes less than or equal to a threshold value, dielectric breakdown occurs due to concentration of electric field on the protrusions 511, causing leak current to flow through the radial gap. More specifically, any of the tips 513 of the protrusions 511 of the uneven portions 51 serve as a starting point for an electric discharge; and the leak current is generated selectively at any of the protrusions 511. The magnitude of the leak current is tens to hundreds of times higher than that of corona current.

On the other hand, as shown in FIG. 18, when the size of the gap between the inner peripheral surface 222 of the seat portion 22 of the housing 2 and the outer peripheral surface 301 of the distal portion 31 of the insulator 3 is close to the thickness of the packing 5, the axial positions of the uneven portions 51 vary in the circumferential direction C. When the axial gap between the tips 513 of the protrusions 511 of the uneven portions 51 and the carbon X adhered to the outer peripheral surface 301 of the distal portion 31 of the insulator 3 becomes less than or equal to the threshold value, dielectric breakdown occurs due to concentration of electric field on the protrusions 511, causing leak current to flow through the axial gap. More specifically, any of the tips 513 of the protrusions 511 of the uneven portions 51 serve as a starting point for an electric discharge; and the leak current is generated selectively at any of the protrusions 511. The magnitude of the leak current is tens to hundreds of times higher than that of corona current.

As a result, with the leak current flowing between the packing 5 and the outer peripheral surface 301 of the distal portion 31 of the insulator 3, it is possible to effectively burn off the carbon X adhered to the outer peripheral surface 301 of the distal portion 31 of the insulator 3.

In addition, in the case of each of the protrusions 511 of the uneven portions 51 having a triangular cross section as shown in FIG. 17, the leak current is generated at the radially inner vertex of the triangular cross section (i.e., the tip 513); and a portion of the outer peripheral surface 301 of the distal portion 31 of the insulator 3 which faces the radially inner vertex of the triangular cross section serves as a starting point for burning off the carbon X.

On the other hand, in the case of each of the protrusions 511 of the uneven portions 51 having a quadrangular cross section as shown in FIG. 20, the leak current is generated at the corners of the quadrangular cross section in the circumferential direction C (or the tips 513); and portions of the outer peripheral surface 301 of the distal portion 31 of the insulator 3 which face the corners of the quadrangular cross section serve as a starting point for burning off the carbon X.

While the above particular embodiments and modifications have been shown and described, it will be understood by those skilled in the art that various further modifications, changes and improvements may be made without departing from the spirit of the present invention.

What is claimed is:

1. A spark plug for an internal combustion engine, the spark plug comprising:

a tubular housing:

a tubular insulator retained in the housing;

a center electrode secured in the insulator with a distal end portion of the center electrode protruding outside the insulator; and a ground electrode provided at a distal end of the housing, the ground electrode having a distal end portion that faces the distal end portion of the center electrode in an axial direction of the spark plug through a spark gap formed therebetween, wherein the housing has a seat portion formed on an inner periphery thereof, the seat portion having a seat surface that faces proximalward, the insulator has a distal portion, a proximal portion that has a larger outer diameter than the distal portion, and a shoulder formed on an outer periphery of the insulator between the distal and proximal portions, the shoulder being arranged to seat on the seat surface of the seat portion of the housing, the spark plug further comprises an annular packing that is interposed between the seat surface of the seat portion of the housing and the shoulder of the insulator, and wherein on an inner peripheral surface of the seat portion of the housing which faces an outer peripheral surface of the distal portion of the shoulder, there are formed a plurality of uneven portions that are arranged in a circumferential direction of the spark plug, each of the uneven portions consisting of a protrusion and a recess that adjoin each other in the circumferential direction.

2. The spark plug as set forth in claim 1, wherein the uneven portions are formed on the inner peripheral surface of the seat portion of the housing over an entire axial length of the inner peripheral surface.

3. The spark plug as set forth in claim 1, wherein the uneven portions are formed on the inner peripheral surface of the seat portion of the housing only in an axial range from a distal end to an axial center position of the inner peripheral surface.

4. The spark plug as set forth in claim 1, wherein each of the protrusions of the uneven portions has a triangular cross section perpendicular to the axial direction of the spark plug.

5. The spark plug as set forth in claim 1, wherein each of the protrusions of the uneven portions has a quadrangular cross section perpendicular to the axial direction of the spark plug.

6. The spark plug as set forth in claim 1, wherein the protrusions of the uneven portions are arranged in the circumferential direction of the spark plug at an angular pitch in a range of 5 to 30°.

7. The spark plug as set forth in claim 1, wherein a gap between tips of the protrusions of the uneven portions and the outer peripheral surface of the distal portion of the insulator is in a range of 0.05 to 0.4 mm.

8. The spark plug as set forth in claim 1, wherein tips of the protrusions of the uneven portions are rounded so as to have a radius of curvature less than or equal to 0.3 mm.

9. The spark plug as set forth in claim 1, wherein tips of the protrusions of the uneven portions are chamfered with a chamfering width being less than or equal to 0.3 mm.

10. A spark plug for an internal combustion engine, the spark plug comprising:

a tubular housing:

a tubular insulator retained in the housing;

a center electrode secured in the insulator with a distal end portion of the center electrode protruding outside the insulator; and a ground electrode provided at a distal end of the housing, the ground electrode having a distal end portion that faces the distal end portion of the center electrode in an axial direction of the spark plug through a spark gap formed therebetween, wherein the housing has a seat portion formed on an inner periphery thereof, the seat portion having a seat surface that faces proximalward, the insulator has a distal portion, a proximal portion that has a larger outer diameter than the distal portion, and a shoulder formed on an outer periphery of the insulator between the distal and proximal portions, the shoulder being arranged to seat on the seat surface of the seat portion of the housing, the spark plug further comprises an annular packing that is interposed between the seat surface of the seat portion of the housing and the shoulder of the insulator, and wherein on an inner peripheral surface of the packing, there are formed a plurality of uneven portions that are arranged in a circumferential direction of the spark plug, each of the uneven portions consisting of a protrusion and a recess that adjoin each other in the circumferential direction.

11. The spark plug as set forth in claim 10, wherein each of the protrusions of the uneven portions has a triangular cross section perpendicular to the axial direction of the spark plug.

12. The spark plug as set forth in claim 10, wherein each of the protrusions of the uneven portions has a quadrangular cross section perpendicular to the axial direction of the spark plug.

13. The spark plug as set forth in claim 10, wherein the protrusions of the uneven portions are arranged in the circumferential direction of the spark plug at an angular pitch in a range of 5 to 30°.

14. The spark plug as set forth in claim 10, wherein a radially inner end portion of the packing is bent distalward so that tips of the protrusions of the uneven portions formed on the inner peripheral surface of the packing protrude distalward from a corner edge of the seat portion of the housing, the corner edge being formed between the seat surface and an inner peripheral surface of the seat portion of the housing, and a protruding amount of the tips of the protrusions of the uneven portions from the corner edge of the seat portion of the housing distalward in the axial direction is in a range of 0 to 1 mm.

15. The spark plug as set forth in claim 10, wherein tips of the protrusions of the uneven portions are rounded so as to have a radius of curvature less than or equal to 0.3 mm.

16. The spark plug as set forth in claim 10, wherein tips of the protrusions of the uneven portions are chamfered with a chamfering width being less than or equal to 0.3 mm.

* * * * *